US005407447A

United States Patent [19]

Teague et al.

[11] Patent Number: 5,407,447

[45] Date of Patent: Apr. 18, 1995

[54] SALT-AND-PEPPER DENIM

[75] Inventors: Edward W. Teague; Jarvis L. Clark; Max H. Hance, all of Mooresville, N.C.

[73] Assignee: Burlington Industries, Greensboro, N.C.

[21] Appl. No.: 12,905

[22] Filed: Feb. 3, 1993

Related U.S. Application Data

[62] Division of Ser. No. 322,130, Mar. 10, 1989, Pat. No. 5,330,538.

[51] Int. Cl.[6] ..... D06P 5/00

[52] U.S. Cl. ..... 8/483; 8/478; 8/918

[58] Field of Search ..... 8/483, 478, 918

[56] References Cited

U.S. PATENT DOCUMENTS

| | | | |
|---|---|---|---|
| 3,177,644 | 4/1965 | Aspy | 57/140 |
| 4,033,103 | 7/1977 | Vilkoje | 57/24 HS |
| 4,095,944 | 6/1978 | Duckworth | 8/115.7 |
| 4,283,194 | 8/1981 | Teague | 8/494 |
| 4,345,908 | 8/1982 | Mohr, Jr. | 8/111 |
| 4,355,499 | 10/1982 | Takai | 57/205 |
| 4,486,197 | 12/1984 | Sloan | 8/493 |
| 4,487,608 | 12/1984 | Sloan | 8/493 |
| 4,586,934 | 5/1986 | Blalock et al. | 8/483 |
| 4,613,336 | 9/1986 | Quinnen | 8/494 |
| 4,898,642 | 2/1990 | Moore | 8/116.4 |
| 5,082,468 | 1/1992 | Hopkins | 8/483 |
| 5,114,426 | 5/1992 | Milora et al. | 8/483 |
| 5,215,543 | 6/1993 | Milora et al. | 8/483 |

FOREIGN PATENT DOCUMENTS 4942866 6/1970 Japan .

OTHER PUBLICATIONS

Carmichael et al., Callaway Textile Dictionary, 1st Edition, LaGrange, Ga., p. 362, 1965.

*Primary Examiner*—Jerry D. Johnson

*Attorney, Agent, or Firm*—Rhodes, Coats & Bennett

[57] ABSTRACT

A method for producing a dyed cotton fabric having an improved characteristic salt-and-pepper look and the product thereof. The process includes forming a plurality of individual cotton yarns having a twist multiple value of at least 4.6 and, preferably, subjecting the twisted cotton yarn to exposure to a caustic solution under tension. The yarn then is dyed under tension by exposure to a dye liquor. The treated yarn is used to produce a woven fabric, which after being abraded, has a lighter portion dispersed throughout a darker portion. In the preferred embodiment the twist multiple value of the cotton yarn threads varies within the range of between 4.6 and 10.5.

3 Claims, 8 Drawing Sheets

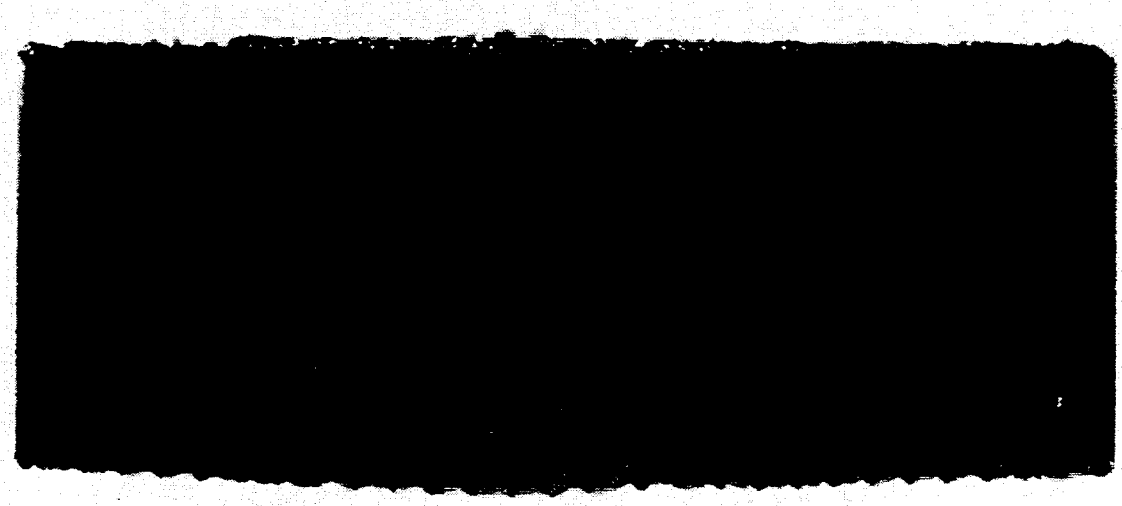
FIG. 2A
FIG. 2B
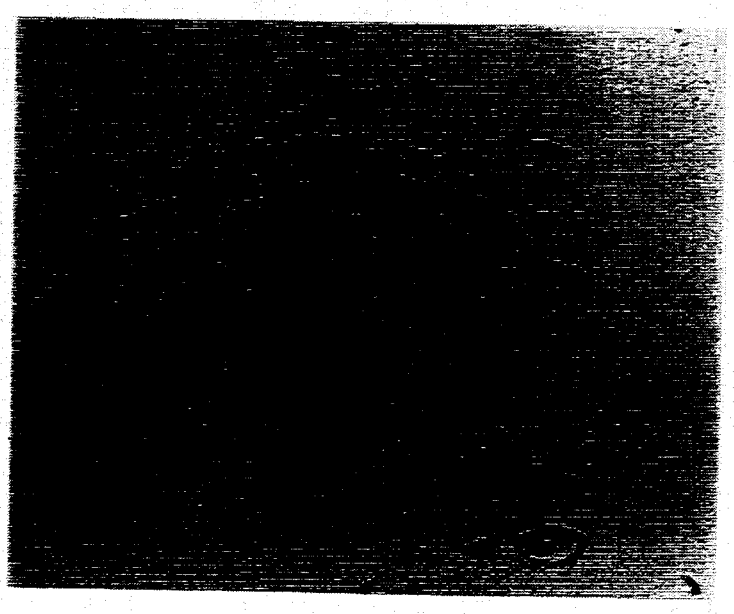

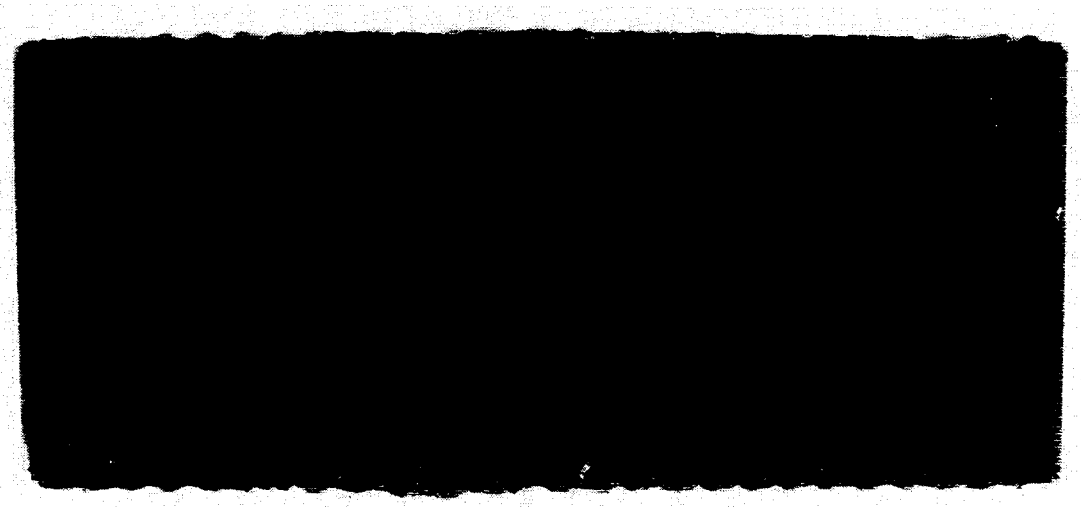
FIG. 3A
FIG. 3B
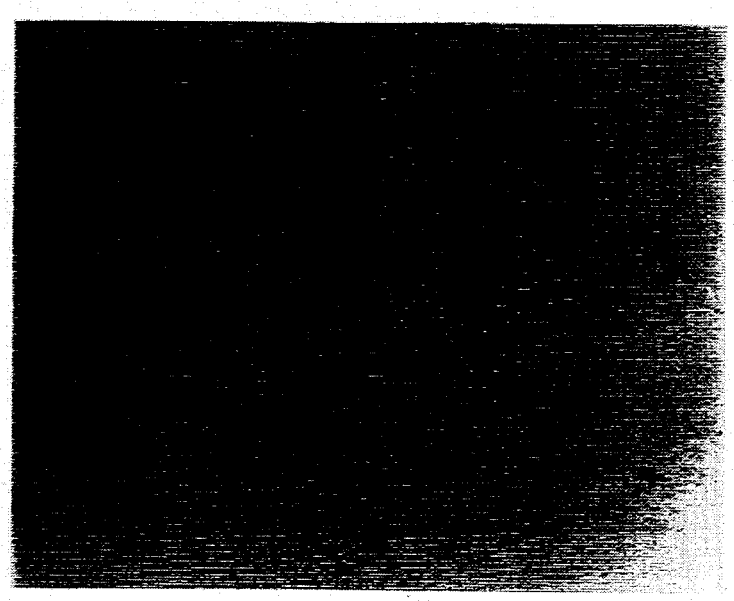

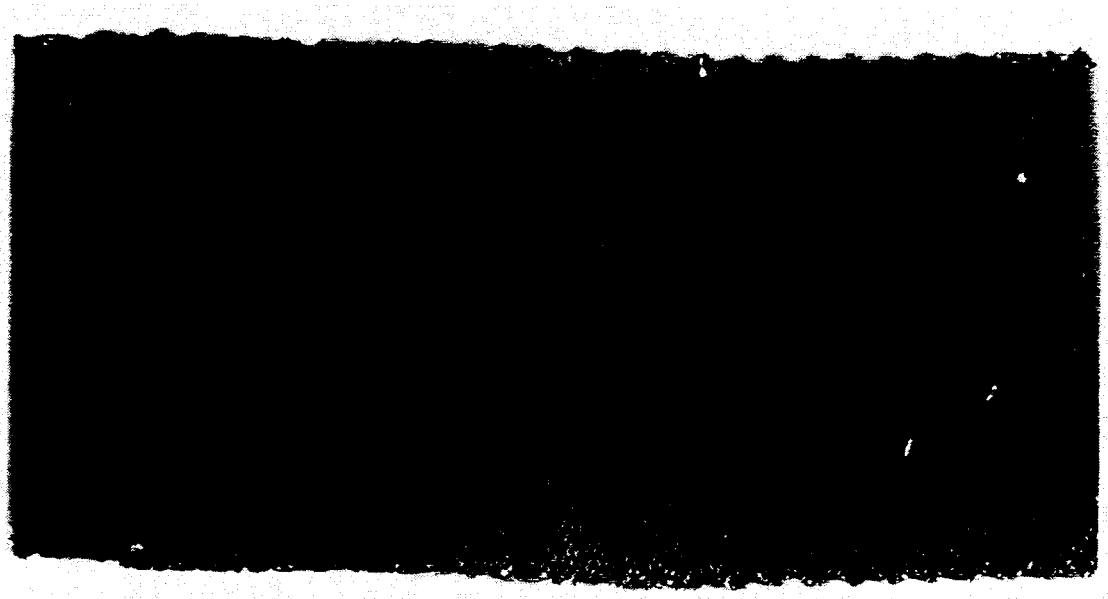
FIG. 4A
FIG. 4B
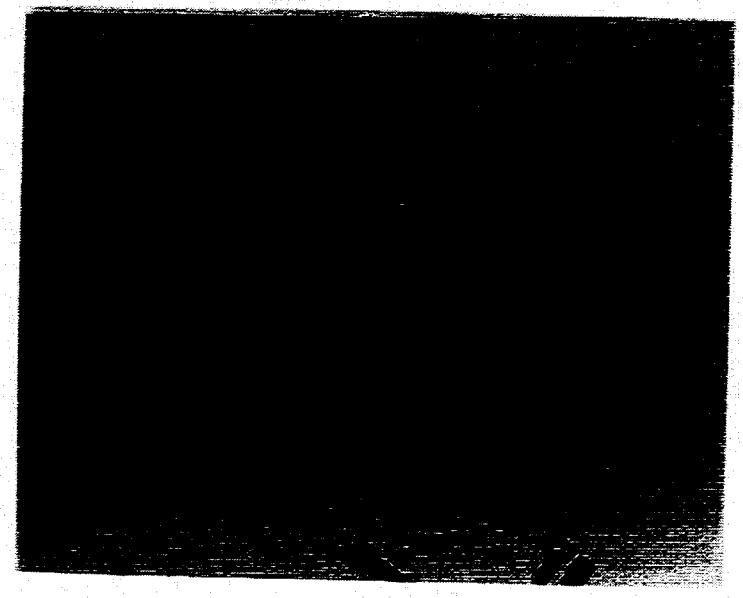

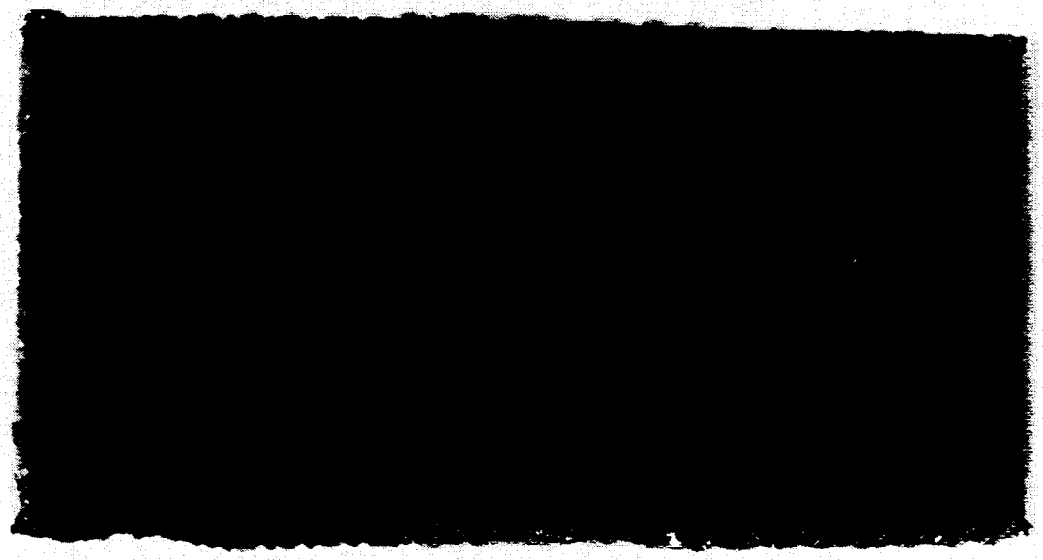
FIG. 5A
FIG. 5B
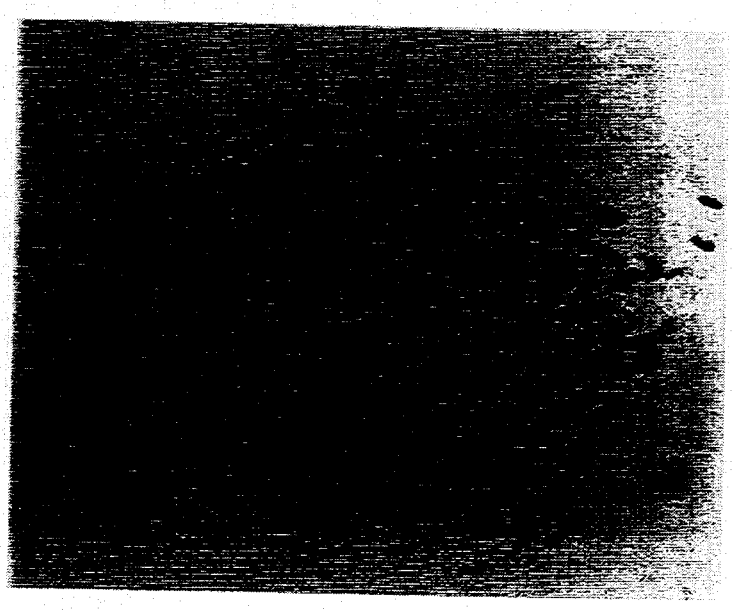

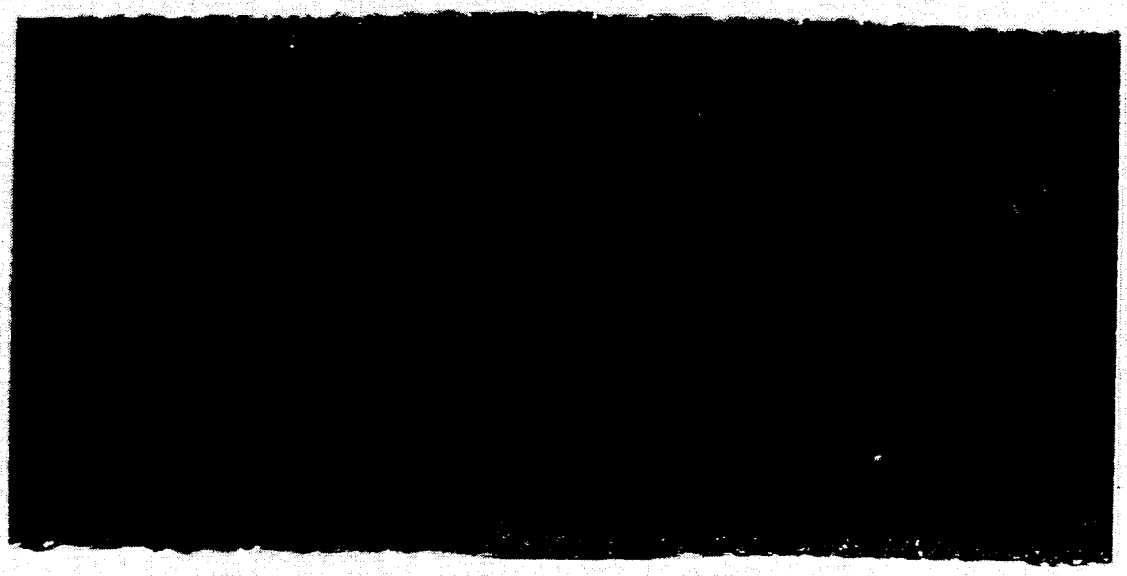
FIG. 6A
FIG. 6B
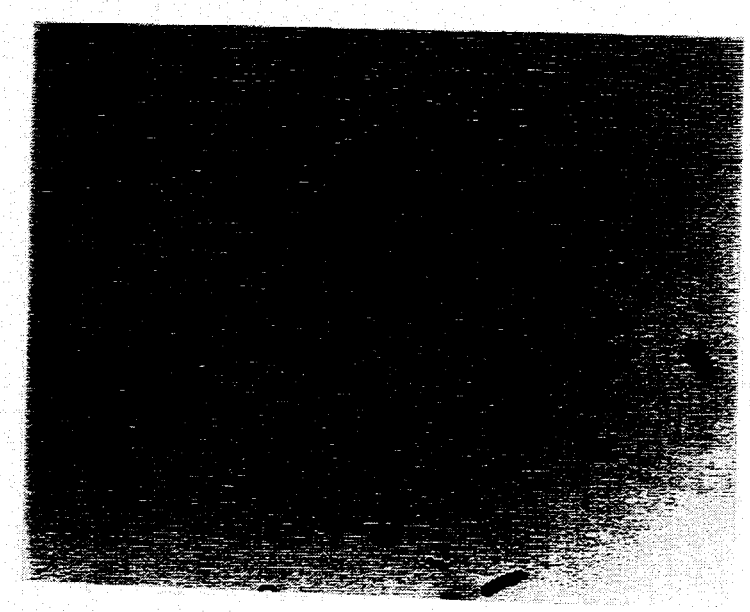

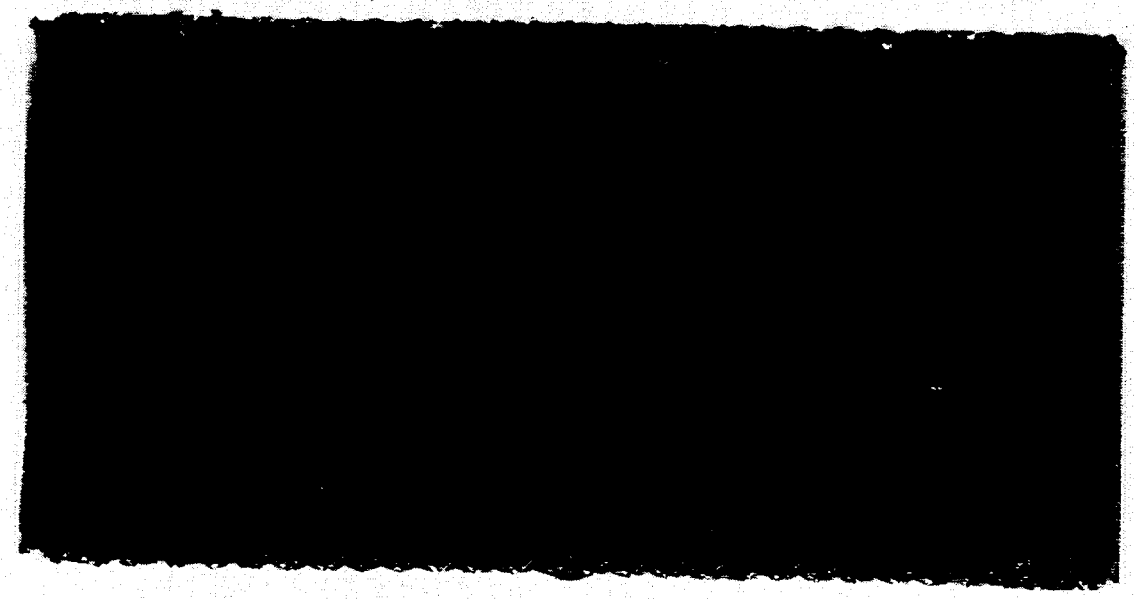
FIG. 7A
FIG. 7B
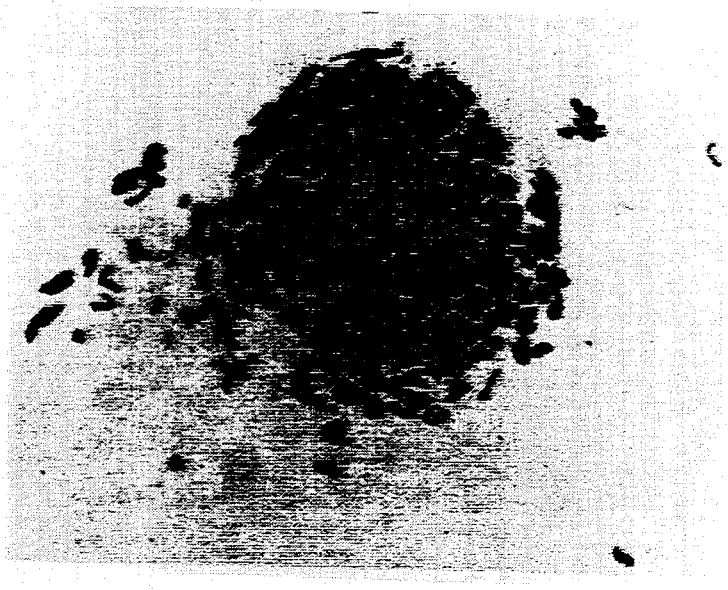

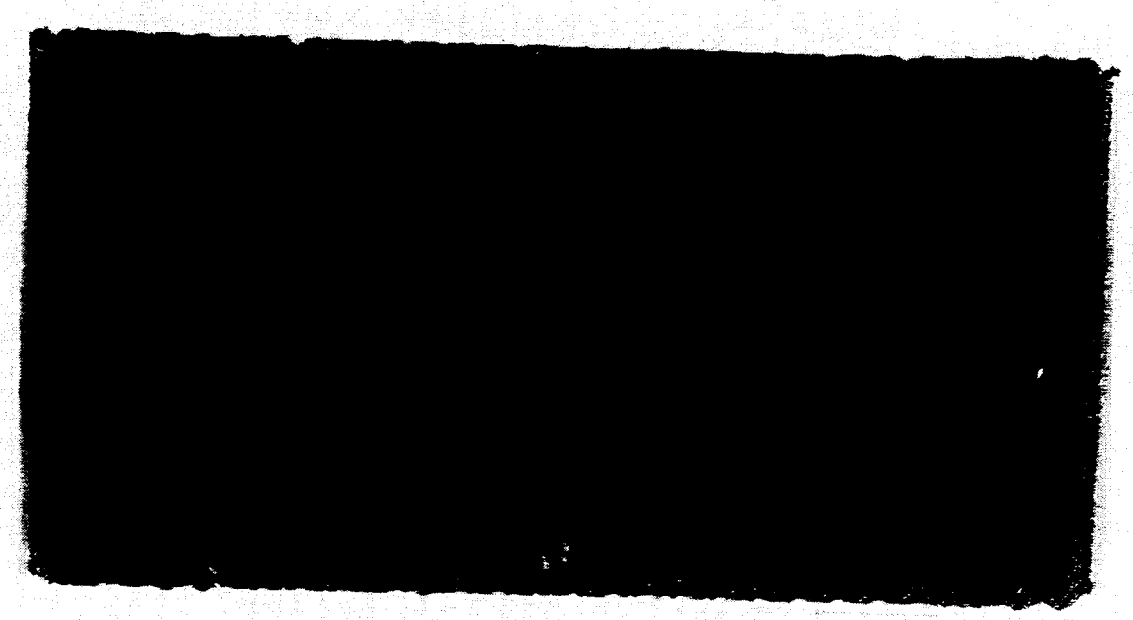
FIG. 8A
FIG. 8B
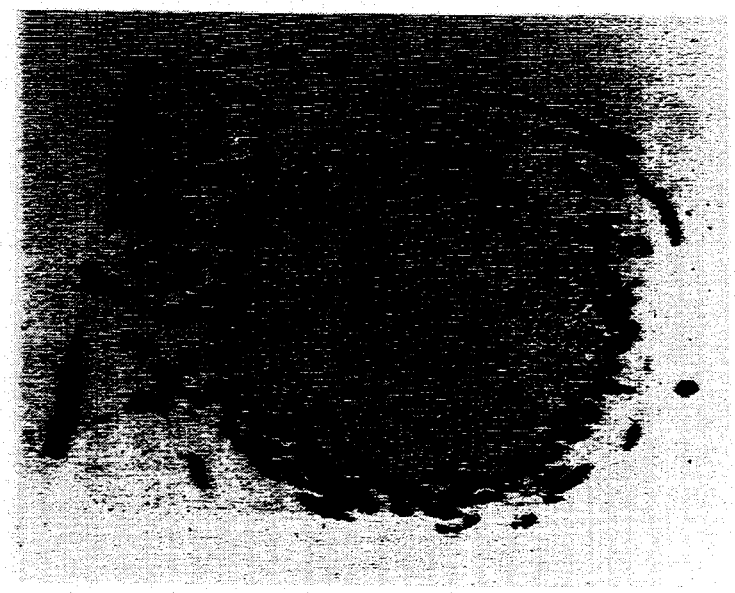

SALT-AND-PEPPER DENIM

This application is a continuation of application Ser. No. 322,130, filed Mar. 10, 1989, now U.S. Pat. No. 5,330,538.

BACKGROUND OF THE INVENTION

1. Field of the Invention

The present invention relates to fabrics having salt-and-pepper patterns and, in particular, to denim warp yarns for producing these effects.

2. Description of The Prior Art

Fabrics having a "salt-and-pepper" pattern are desirable both for aesthetic reasons, such as fashion, as well as because such fabrics tend to obscure streaking and other dyeing variations. In order to produce this effect, the yarn has to be changed so it is capable of producing different shades of colors along it lengths after dyeing.

For filament yarns (i.e., polyester), this has been accomplished by one of three ways. One technique, illustrated in U.S. Pat. No. 3,177,644 issued to Aspy et al., includes using at least two different heat-settings or tow-drying temperatures to product different degrees of dyeing susceptibility in synthetic filament yarn. Thus, combining two or more different dye affinity types into a yarn will produce a fabric having the characteristic salt-and-pepper pattern. The second technique for filament yarns includes structurally transforming a single filament yarn along its length such that the filament yarn has different shades of color along its length on dyeing. A third method of making a fabric having salt-and-pepper pattern filament yarns is produced from a crimped filament yarn having S-twist and Z-twist portions distributed in alternation along the length of the filament yarn. When the fabric made from such crimped yarn is dyed, the tightly bound portions take a dark shade of color and the loosely bound portions a light shade, thereby producing a salt-and-pepper pattern. One such process is disclosed in U.S. Pat. No. 4,355,499 issued to Takai. The fabric produced by this process is actually an optical illusion since the individual fibers are equally dyed. Such techniques are not at all helpful in producing a salt-and-pepper look with denim fabric.

For natural fibers, such as cotton, the salt-and-pepper pattern can be created by first dyeing the yarn or fabric with a dye that normally dyes only the outer surface of the fiber bundle which gives the appearance of a ring when viewed in a cross-section of the fiber bundle, and subsequently abrading at least a portion of the dyed surface away either by chemical or physical means, such as "stone-washing". This method has not been completely satisfactory since considerable amount of the fabric must be abraded away before the salt-and-pepper pattern becomes apparent. It has, thus, become desirable to develop a cotton fabric having an improved salt-and-pepper pattern which at the same time will minimize the amount of yarn or fabric abrasion necessary to produce a satisfactory result.

SUMMARY OF THE INVENTION

The present invention solves the aforementioned problems associated with the prior art by providing a technique for producing a fabric which has a superior salt-and-pepper look after stone-washing. According to the present invention, cotton warp yarns are first prepared by twisting in a range of 4.6 to 10.5 TM (twist multiple) to create areas of variable tightness of the surface and density of the yarn. This is a greater amount of twist than is known to have been used in any prior art denim manufacture. At the higher twist levels, the amount of twist is not constant along the yarn length. Since the degree of dye pickup is inversely related to the tightness of the yarn bundle, the tighter twist areas will pick up less dye than the looser areas, and this effect will be varied along the length of the yarn.

The twisted yarn is then preferably mercerized by immersion in a caustic solution under tension such as a sodium hydroxide or potassium hydroxide solution. As is known, mercerization will increase the affinity for dyes (including the dyes used herein) of the yarns. However, in the subject invention, this step is controlled by maintaining tension to the yarn to permit substantially only the surface of the yarn to receive the caustic treatment. Since tension is maintained on the yarn, movement of the caustic into the fiber bundle is inhibited. As with the dye pickup, the caustic absorption is also affected by the yarn bundle tightness, so less mercerization takes place in the tighter parts of the yarn.

The tension is maintained until the yarn has been washed free of the caustic solution. The yarn is then dyed in a conventional manner using indigo, sulfur, napthol, vats, or other suitable dyes. After weaving, the fabric is stone-washed in a conventional manner to bring out the salt-and-pepper pattern. Preferably, the fabric may be made up into garments or other articles with subsequent stone-washing.

Accordingly, it is an object of the present invention to provide a method for preparing a yarn suitable for production of such a fabric.

Another object of the present invention is to provide a cotton yarn suitable for preparing such a fabric.

A further object is to provide a fabric knitted from such a yarn.

Still another object of the present invention is to provide a fabric whose surface has a salt-and-pepper pattern.

A still further object is to provide a garment of a fabric whose surface has a salt-and-pepper pattern.

These and other aspects of the present invention will be more clearly understood after review of the following description of the preferred embodiment of the invention when considered with the drawings.

BRIEF DESCRIPTION OF THE DRAWINGS

FIGS. 2A and 2B illustrate a pattern appearing on a fabric woven from normal twist, 8-dip indigo dyed yarn after stone-washing and a photomicrograph of a representative fiber bundle, respectively.

FIGS. 3A and 3B illustrate a pattern appearing on a fabric woven from normal twist, 8-dip indigo dyed yarn, subject to a pre-treatment with caustic, after stone-washing and a photomicrograph of a representative fiber bundle, respectively.

FIGS. 4A and 4B illustrate a pattern appearing on a fabric woven from 8-dip indigo dyed yarn processed according to the present invention, after stone-washing and a photomicrograph of a representative fiber bundle, respectively.

FIGS. 5A and 5B illustrate a pattern appearing on a fabric woven from normal twist, 6-dip indigo dyed yarn after stone-washing and a photomicrograph of a representative fiber bundle, respectively.

FIGS. 6A and 6B illustrate a pattern appearing on a fabric woven from high twist, 6-dip indigo dyed yarn after stone-washing and a photomicrograph of representative fiber bundle, respectively.

FIGS. 7A and 7B illustrate a pattern appearing on a fabric woven from normal twist, sulfur black yarn after stone-washing and a photomicrograph of a representative fiber bundle, respectively.

FIGS. 8A and 8B illustrate a pattern appearing on a fabric woven from sulfur black dyed yarn, processed according to the present invention, after stone-washing and a photomicrograph of a representative fiber bundle, respectively.

DESCRIPTION OF THE PREFERRED EMBODIMENT

Figure 1:
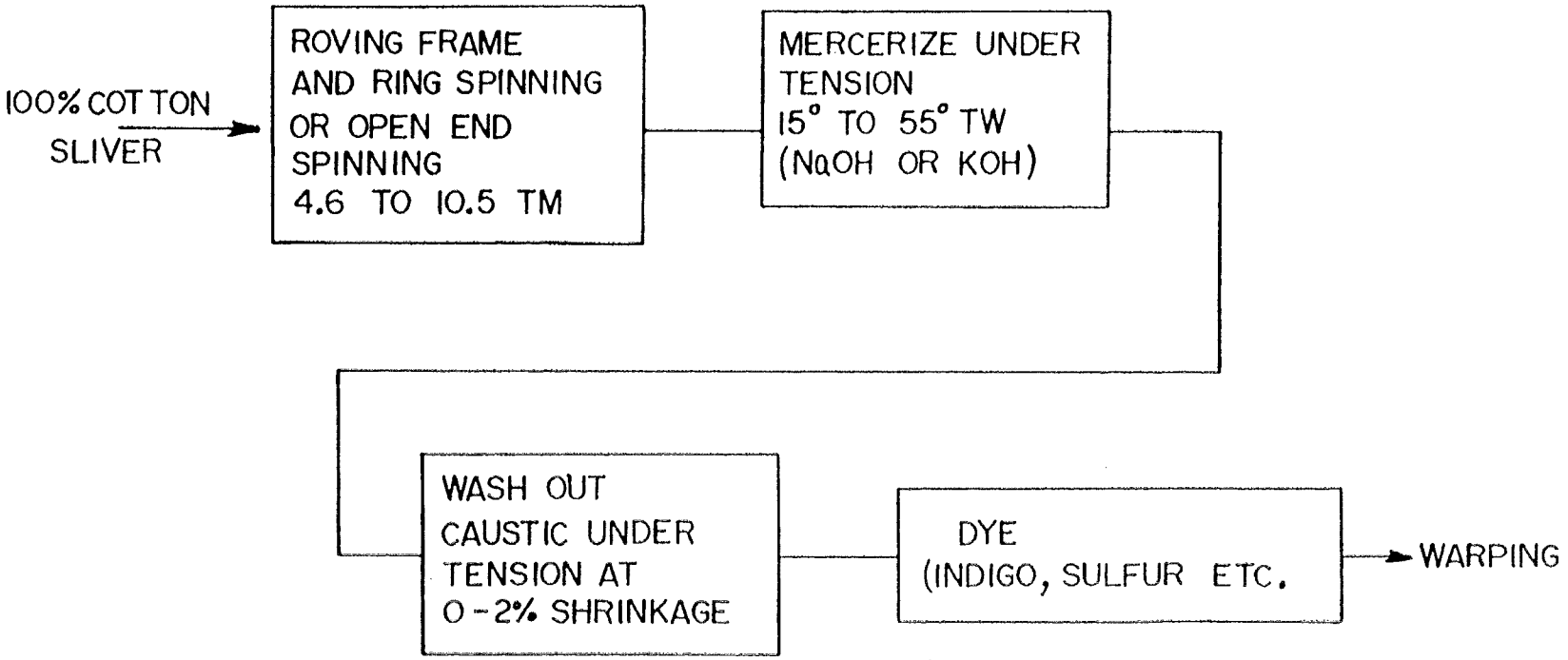
FIG. 1 is a diagrammatic representation of a process applicable to producing a special effect warp yarns according to the present invention.

Referring now the drawings in general, and to FIG. 1 in particular, it will be understood that the illustrations are for the purpose of describing a preferred embodiment of the present invention and are not intended to limit the invention hereto.

Referring now to FIG. 1, a diagrammatic representation of a process applicable to producing special effect warp yarns according to the present invention is shown.

According to the present invention, 100% cotton warp yarns are first prepared by twisting to a range of 4.6 to 10.5 TM (twist multiple) so that the yarn is tightly twisted and, at the same time, areas of variable tightness in the surface and density of the yarn are created. Various suitable yarn-making systems can be employed to create this condition, such as conventional ring-spinning and open-end spinning. Yarn counts from 4/1 to 20/1 are preferred, but others could be used. Suitable ring-spinning systems include the Rieter and the Saco Lowell ring-spinning frames. In addition, suitable open-end spinning systems include the 168 spindle Rieter M 1-1 and the 144 spindle Schlafhorst Autocoro. Other spinning frames and types can be used.

At the higher twist levels, the precise amount of twist at a given point in the yarn is likely to be different from an adjacent point, causing variations in the absorbancy of the yarn along its length. These lead to variations in dye penetration, which, after using the yarn to make cloth, lead to generation of a salt-and-pepper look through stone-washing of the fabric or garment made from the fabric. In the embodiment of the invention using mercerization, the variations in twist cause variations in the amount of mercerization taking place along the length of the yarn, and this causes a greater salt-and-pepper effect in the completed fabric and/or garment.

In the embodiment using mercerization, following the twisting step, the twisted yarn is treated with a caustic solution, such as a sodium or potassium hydroxide solution at a strength of between 15° and 75° Twaddell scale (Tw) so as to set the twist and increase the dye affinity of the cotton in the yarn, thereby permitting dyeing of dark shades with a minimum of dye penetration into the yarn bundle. In the embodiments, the temperature of the caustic solution is less than 215° F. and preferably in the range of 90°–100° F. Only the surface of the yarn is allowed to wet out and receive the caustic treatment. In addition, tension is maintained on the yarn during this treatment step so that a shrinkage of less than 5% occurs. Maintaining the tension further inhibits the movement of the caustic into the fiber bundle. Tension is maintained until the yarn has been washed free of the caustic.

Whether or not caustic is used, the yarn is dyed with indigo, sulfur, napthol, vats or other suitable dyes and an exaggerated ring-dyeing effect occurs. The dye can be applied either by a wet-on-wet dyeing system or by first drying the yarn and then dyeing it by the conventional dry-yarn-into-dye system. Indigo dye, for example, normally dyes in a ring on the outside of the fiber bundle, but when treated according to the present invention, the white core of the yarn is larger and whiter, thereby making a more positive contribution to the creation of the "salt" of the salt-and-pepper look after stone-washing.

When caustic is used, the combination of the variation in yarn twist, which creates areas in the yarn that are tighter than other areas, and the mercerization step, which produces a fast dye rate for the dye in the outer fibers, produces an accentuated variation in the degree of dye penetration into the fiber bundle along the length of the yarn. This variation shows as dispersed white areas within the dyed surface of the fabric when the warp yarns are abraded by stone-washing garments produced from such fabric. The stone-washing time required to achieve optimum results is, on average, about one and one-half hours. The salt-and-pepper appearance can be brought out by abrasion techniques other than stone-washing, such as abrasives, rolls, sandpaper, blasting with sand and other abrasive pellets, as well as chemical abrasives.

A further understanding of the present invention can be had from consideration of the following examples which are set forth to illustrate certain preferred embodiments.

Table 1, shown below, provides a quantitative comparison of the visual appearance of Examples 1–7 corresponding to FIGS. 2A–8A, respectively. FIGS. 2A to 8A were produced xerographically from representative fabric swatches. The measurements include: 1) the fractional area, in percent, of the "salt" features; 2) the average number of "salt" features per square inch; 3) the average individual "salt" feature area ($\times 10^{-3}$ in$^2$); and 4) the improvement,in percent, in the average individual "salt" feature area of the present invention over conventional processing for 8-dip indigo dyed, 6-dip indigo dyed, and sulfur black dyed denim, respectively. The measurements were made using well-known quantitative microscopy techniques, such as set forth in *Quantitative Sterology* by E. E. Underwood, published by Addison, Wesley Publishing Co., Inc., Reading, Mass. (1970).

TABLE 1

| Example No. | Low Twist Yarn | High Twist Yarn | w/o Caustic Trtmnt. | With Caustic Trtmnt. | "Salt" Values as Measured | | | |
|---|---|---|---|---|---|---|---|---|
| | | | | | Fract. Area | # Feat./ sq. in | Avg. Feat. Area ($\times 10^{-3}$in$^2$) | Impr. In Avg. Feat. Area |
| 8-dip Indigo | | | | | | | | |
| 1(Prior Art) | X | | X | | 19% | 240 | 0.79 | — |
| 2(Present Invention) | X | | | X | 32% | 380 | 0.84 | 6% |
| 3(Present Invention) | | X | | X | 48% | 430 | 1.1 | 39% |

TABLE 1-continued

| Example No. | Low Twist Yarn | High Twist Yarn | w/o Caustic Trtmnt. | With Caustic Trtmnt. | "Salt" Values as Measured | | | |
|---|---|---|---|---|---|---|---|---|
| | | | | | Fract. Area | # Feat./ sq. in | Avg. Feat. Area ($\times 10^{-3}$in$^2$) | Impr. In Avg. Feat. Area |
| 6-dip Indigo | | | | | | | | |
| 4(Prior Art) | X | | X | | 22% | 430 | 0.77 | — |
| 5(Present Invention) | | X | X | | 43% | 420 | 1.0 | 37% |
| Sulfur Black | | | | | | | | |
| 6(Prior Art) | X | | X | | 33% | 430 | 0.77 | — |
| 7(Present Invention) | | X | | X | 44% | 410 | 1.1 | 43% |

Table 2, shown below, provides a quantitative comparison of the specific fabric construction of each of the above examples.

TABLE 2

| Example No. | Warp Yarn Count | Ends/in. | Pick Yarn Count | Picks/ in. |
|---|---|---|---|---|
| 8-dip Indigo | | | | |
| 1(Prior Art) | 5.6/1 | 59 | 5.6/1 | 40.5 |
| 2(Present Invention) | 5.6/1 | 59 | 5.6/1 | 40.5 |
| 3(Present Invention) | 5.5/1 | 60 | 5.6/1 | 40.5 |
| 6-dip Indigo | | | | |
| 4(prior Art) | 5.6/1 | 59 | 5.6/1 | 40.5 |
| 5(Present Invention) | 5.5/1 | 59 | 5.6/1 | 40.5 |
| Sulfur Black | | | | |
| 6(Prior Art) | 6.65/1 | 64 | 5.0/1 | 43.5 |
| 7(Present Invention) | 5.5/1 | 60 | 5.5/1 | 40.5 |

EXAMPLE 1

100% cotton yarns were twisted at a 4.6 TM. The yarns were not treated with caustic before being dyed with indigo dye in an 8-dip conventional process. The yarns were used as the warp to produce denim fabrics which were fabricated into garments. After stone-washing, the garments showed few "salt-and-pepper" highlights and were primarily a blue color with no clean, white "salt" points showing (see FIG. 2A). A photomicrograph of a representative fiber bundle, prior to stone-washing, shows a loose fiber bundle with an open, irregular surface. One or two layers of fibers on the outside of the fiber bundle are dyed and some dye has penetrated into the fiber bundle (see FIG. 2B).

EXAMPLE 2

100% cotton yarns were twisted at a 4.6 TM. The yarns were treated with caustic before being dyed with indigo dye in an 8-dip conventional process. The yarns were used as the warp to produce denim fabrics which were fabricated into garments. After stone-washing, the garments showed more "salt-and-pepper" highlights and were primarily a blue color with cleaner white "salt" points showing (see FIG. 3A). A photomicrograph of a representative fiber bundle, prior to stone-washing, shows a more compact fiber bundle with fewer air spaces. The surface is still somewhat irregular. Two layers of fibers on the outside of the fiber bundle are dyed. Less dye has penetrated into the fiber bundle (see FIG. 3B).

EXAMPLE 3

100% cotton yarns were twisted between 4.6 and 10.5 TM. The yarns were treated with caustic before being dyed with indigo dye in an 8-dip conventional process. The yarns were used as the warp to produce denim fabrics which were fabricated into garments. After stone-washing, the garments showed many "salt-and-pepper" highlights and were a blue color with clean, white "salt" points showing (see FIG. 4A). A photomicrograph of a representative fiber bundle, prior to stone-washing, shows a compact fiber bundle with a round regular surface. One-half to one layer of fibers on the outside of the fiber bundle are dyed and little dye has penetrated into the fiber bundle (see FIG. 4B).

EXAMPLE 4

100% cotton yarns were twisted at a 4.6 TM. The yarns were not treated with caustic before being dyed with indigo dye in a 6-dip conventional process. The yarns were used as the warp to produce denim fabrics which were fabricated into garments. After stone-washing, the garments showed few "salt-and-pepper" highlights and were primarily a blue color with no clean, white "salt" points showing (see FIG. 5A). A photomicrograph of a representative fiber bundle, prior to stone-washing, shows a loose fiber bundle with an open irregular surface. One or two layers of fibers on the outside of the fiber bundle are dyed and some dye has penetrated into the fiber bundle (see FIG. 5B).

EXAMPLE 5

100% cotton yarns were twisted between 4.6 and 10.5 TM. The yarns were not treated with caustic before being dyed with indigo dye in a 6-dip conventional process. The yarns were used as the warp to produce denim fabrics which were fabricated into garments. After stone-washing, the garments showed more "salt-and-pepper" highlights and were primarily a blue color with cleaner white "salt" points showing (see FIG. 6A). A photomicrograph of a representative fiber bundle, prior to stone-washing, shows a more compact fiber bundle with little air space between fibers. One-half to one layer of fibers on the outside of the fiber bundle are dyed and little dye has penetrated into the fiber bundle (see FIG. 6B).

EXAMPLE 6

100% cotton yarns were twisted at a 4.6 TM. The yarns were not treated with caustic before being dyed with sulfur black dye in a conventional process. The yarns were used as the warp to produce denim fabrics which were fabricated into garments. After stone-washing, the garments showed few "salt-and-pepper" highlights and were primarily a black color with some clean, white "salt" showing (see FIG. 7A). A photomicrograph of a representative fiber bundle, prior to stone-washing, shows a loose fiber bundle with an open irregular surface. One or two layers of fibers on the outside of the fiber bundle are dyed and dye has penetrated into the fiber bundle (see FIG. 7B).

EXAMPLE 7

100% cotton yarns were twisted between 4.6 and 10.5 TM. The yarns were treated with caustic before being dyed with sulfur black in a conventional process. The yarns were used as the warp to produce denim fabrics which were fabricated into garments. After stone-washing, the garments showed many "salt-and-pepper" highlights and were a black color with clean, white "salt" showing (see FIG. 8A). A photomicrograph of a representative fiber bundle, prior to stone-washing, shows a compact fiber bundle with a round regular surface. One-half or one layer of fibers on the outside of the fiber bundle are dyed and little dye has penetrated into the fiber bundle (see FIG. 8B).

The preceding examples illustrate the production of a fabric having an improved "salt-and-pepper" pattern and a high twist warp yarn for producing the fabric having an exaggerated ring-dyeing effect which may be abraded away to produce a "salt-and-pepper" appearance.

As with most stone-washing of denim, preferably, the fabric is made up into the jeans, jackets, or other article prior to stone-washing. This helps to accentuate the "salt" component at natural wear points such as seams, creases, and the like.

Alternatively, the yarn made as described above may be used as a knitting yarn, for example using the procedures as described in U.S. Pat. No. 4,613,336 to Quinnen, the entire disclosure of which is hereby incorporated by reference.

Certain modifications and improvements would occur to those skilled in the art in the reading of the foregoing description. By way of example, yarn sizes could be varied beyond limits specified, or various other fibers, such as polyester, nylon, rayon, jute, or linen could be blended with cotton, and would still get the above described effects. It should be understood that all such modifications and improvements have been deleted herein for the sake of conciseness and readability but are properly within the scope of the following claims.

We claim:

1. A dyed cotton fabric having white portions dispersed throughout dyed portions, said white portions having an average feature area value of greater than $1.0\times10^{-3}$ in$^2$, said fabric being made by preparing yarns of which the fabric is made by a pretreatment to limit dye penetration of the yarns, dyeing the yarns to achieve dyeing of the periphery of the yarn, forming the yarn into the fabric and subsequently abrading the fabric to wear away outer parts of the yarn and expose the core of the yarn to form said white portions.

2. A dyed cotton fabric having white portions dispersed throughout dyed portions, said white portions having a fractional area value of at least 32% and an average feature area value of at least $0.8\times10^{-3}$ in$^2$, said fabric being made by preparing yarns of which the fabric is made by a pretreatment to limit dye penetration of the yarns, dyeing the yarns to achieve dyeing of the periphery of the yarn, forming the yarn into the fabric and subsequently abrading the fabric to wear away outer parts of the yarn and expose the core of the yarn to form said white portions.

3. A fabric according to claim 1, wherein said fabric has warp yarns and said warp yarns are dyed with indigo dye.

* * * * *